US009051082B1

(12) United States Patent
Klinge et al.

(10) Patent No.: US 9,051,082 B1
(45) Date of Patent: Jun. 9, 2015

(54) BEACH GLASS AND COOPERATING CADDY FOR STORING OR TRANSPORTING

(71) Applicants: Jason E. Klinge, Southampton, NY (US); David D'Agostino, Southampton, NY (US)

(72) Inventors: Jason E. Klinge, Southampton, NY (US); David D'Agostino, Southampton, NY (US)

( * ) Notice: Subject to any disclaimer, the term of this patent is extended or adjusted under 35 U.S.C. 154(b) by 0 days.

(21) Appl. No.: 14/084,988

(22) Filed: Nov. 20, 2013

(51) Int. Cl.
*A47G 19/22* (2006.01)
*B65D 23/00* (2006.01)

(52) U.S. Cl.
CPC ..... *B65D 23/001* (2013.01); *A47G 19/2261* (2013.01)

(58) Field of Classification Search
CPC ..... E04H 15/62
USPC ..... 119/786; 206/426; 215/376, 395; 248/530, 532, 533; 220/475, 628, 636, 220/635, 729, 484, 630
See application file for complete search history.

(56) References Cited

U.S. PATENT DOCUMENTS

| | | | | | |
|---|---|---|---|---|---|
| 774,479 | A | * | 11/1904 | Lange | 206/426 |
| 2,184,192 | A | * | 12/1939 | McCline et al. | 248/513 |
| 2,372,073 | A | * | 3/1945 | Flournoy | 248/149 |
| 2,441,109 | A | * | 5/1948 | Carlson | 403/86 |
| 2,484,263 | A | * | 10/1949 | Atkinson | 119/61.57 |
| 2,706,967 | A | * | 4/1955 | Iannetti | 119/786 |
| 2,752,156 | A | * | 6/1956 | Washburn | 273/349 |
| 2,775,252 | A | * | 12/1956 | Finch | 135/118 |
| 3,627,394 | A | | 12/1971 | Benn et al. | |
| 4,649,678 | A | * | 3/1987 | Lamson | 52/103 |
| 4,659,049 | A | | 4/1987 | Watson | |
| 4,934,661 | A | | 6/1990 | Denman et al. | |
| 5,014,865 | A | * | 5/1991 | Sauber | 215/377 |
| 5,148,626 | A | * | 9/1992 | Haake, Sr. | 43/121 |
| D346,634 | S | * | 5/1994 | Evers | D21/794 |
| 5,586,647 | A | * | 12/1996 | Barta et al. | 206/217 |
| 5,687,946 | A | * | 11/1997 | Cho | 248/530 |
| D403,390 | S | * | 12/1998 | Lenz | D21/794 |
| 6,164,473 | A | * | 12/2000 | Waldrip | 215/378 |
| 6,226,813 | B1 | * | 5/2001 | Wilburn et al. | 5/417 |
| D449,206 | S | | 10/2001 | DuBow | |
| D474,648 | S | | 5/2003 | Dimeo | |
| 7,143,543 | B1 | * | 12/2006 | Daniell | 47/39 |
| D543,783 | S | | 6/2007 | Goldberg | |
| 7,367,859 | B2 | * | 5/2008 | Richardi | 441/6 |
| D664,037 | S | * | 7/2012 | Floyd et al. | D9/516 |
| D705,013 | S | * | 5/2014 | Audibert | D7/620 |
| 8,800,493 | B2 | * | 8/2014 | Harding | 119/61.57 |
| 2004/0026425 | A1 | * | 2/2004 | Galli | 220/475 |
| 2006/0051183 | A1 | * | 3/2006 | Powell et al. | 411/386 |
| 2006/0249089 | A1 | * | 11/2006 | Behunin | 119/61.57 |
| 2009/0149268 | A1 | * | 6/2009 | Sison et al. | 473/226 |
| 2010/0077954 | A1 | * | 4/2010 | Eigel | 116/209 |
| 2010/0209662 | A1 | * | 8/2010 | Slade et al. | 428/131 |
| 2012/0126089 | A1 | * | 5/2012 | Silvestri | 248/530 |
| 2012/0248126 | A1 | * | 10/2012 | Cole | 220/628 |
| 2013/0075351 | A1 | | 3/2013 | Lueker | |
| 2014/0054304 | A1 | * | 2/2014 | Hu | 220/630 |

* cited by examiner

*Primary Examiner* — Fenn Mathew
*Assistant Examiner* — Chetan Chandra
(74) *Attorney, Agent, or Firm* — Richard L. Miller

(57) ABSTRACT

A glass that is self-supporting in a substance consisting of sand, earth, snow, water or vegetation. The glass includes a bowl, a stem, and apparatus that maintains the glass upright in the substance consisting of sand, earth, snow, water or vegetation. The stem depends from the bowl to a point so as to form a spike. The spike of the stem inserts into the substance consisting of sand, earth, snow, water or vegetation.

23 Claims, 9 Drawing Sheets

BEACH GLASS AND COOPERATING CADDY FOR STORING OR TRANSPORTING

BACKGROUND OF THE INVENTION

1. Field of the Invention

The present invention relates to a beach glass, and more particularly, a beach glass and cooperating caddy for storing or transporting.

2. Description of the Prior Art

Numerous innovations for glass holders have been provided in the prior art that will be described. Even though these innovations may be suitable for the specific individual purposes to which they address, however, they differ from the present invention.

A FIRST EXAMPLE, U.S. Pat. Office Document No. 3,627,394, Issued on Dec. 14, 1971, to Benn, et al. teaches a holder for supporting a cup or drinking glass at a beach, so to eliminate the necessity of placing it upon the sand. The holder includes a tapered lower end for insertion into the sand so that it is maintained upright, and an upper end having a receptacle into which a cup is removably placed. The holder is hollow and in screwed-together pieces, so as to provide a compartment for the storage of cups.

A SECOND EXAMPLE, U.S. Pat. Office Document No. 4,659,049, Issued on Apr. 21, 1987, to Watson teaches a device for supporting drinking glasses or other small objects out of contact with beach sand or the earth at other outdoor locations, which has a ground engaging spike with a pointed lower end and a relatively broad upper end on which a plate member is disposed in a transverse and substantially centered relationship with the spike. A retainer structure holds the plate on the spike during use while enabling separation of the plate and spike when not in use. In a preferred form, the spike is itself formed of separable flat elements. The device is disassemble and the components are rearrangeable.

A THIRD EXAMPLE, U.S. Pat. Office Document No. 4,934,661, Published/Issued on Jun. 19, 1990, to Denman, et al. teaches an array of inertial barriers positioned on a support surface alongside a vehicle roadway, which includes a number of separate containers, each having an outer wall and a lower portion. An inner core is positioned within each container to define an annular space between the core and the respective outer wall. The annular space defines an average inner diameter that is at least about 20% of the average outer diameter of the annular space. A dispersible material, such as sand, is disposed in the annular spaces so that no more than 10% of the mass of sand in any container of the array extends in an uninterrupted disc across the respective container.

A FOURTH EXAMPLE, U.S. Pat. Office Document No. Des. 449,206, Issued on Oct. 16, 2001, to DuBow teaches the ornamental design for a wine glass holder.

A FIFTH EXAMPLE, U.S. Pat. Office Document No. Des. 474,648, Issued on May 20, 2003, to Dimeo teaches a the ornamental design for a champagne glass.

A SIXTH EXAMPLE, U.S. Pat. Office Document No. Des. 543,783, Issued on Jun. 5, 2007, to Goldberg teaches the ornamental design for a drinking glass.

A SEVENTH EXAMPLE, U.S. Pat. Office Document No. 2013/0075351, Published on Mar. 28, 2013, to Lueker teaches an apparatus including one or more beverage container receptacles for holding a beverage container in the upright position in multiple convenient and possibly unstable locations. Slender legs separate the beverage container receptacles from direct contact with the mounting or bearing surfaces and serve to damp spilling forces transmitted from these surfaces when the apparatus is placed in various horizontal or vertical orientations, such as vertically between couch cushions or horizontally between a bed mattress and box spring or on a picnic blanket. Multiple stemmed and non-stemmed beverage container types, such as wine glasses, coffee cups, and large soda cups, are simultaneously held. Additional storage space for personal effects, such as digital electronic devices, remote controls, or reading glasses, is included. One embodiment includes speakers, amplifying electronics, and batteries for playing digital music from a users digital electronic device.

It is apparent now that numerous innovations for glass holders have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a beach glass and cooperating caddy for storing or transporting that avoids the disadvantages of the prior art.

ANOTHER OBJECT of the present invention is to provide a beach glass and cooperating caddy for storing or transporting that is simple and inexpensive to manufacture.

STILL ANOTHER OBJECT of the present invention is to provide a beach glass and cooperating caddy for storing or transporting that is simple to use.

BRIEFLY STATED, STILL YET ANOTHER OBJECT of the present invention is to provide a glass that is self-supporting in a substance consisting of sand, earth, snow, water or vegetation. The glass includes a bowl, a stem, and a ball apparatus that maintains the glass upright in the substance consisting of sand, earth, snow, water or vegetation. The stem depends from the bowl to a point so as to form a spike. The spike of the stem inserts into the substance consisting of sand, earth, snow, water or vegetation.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
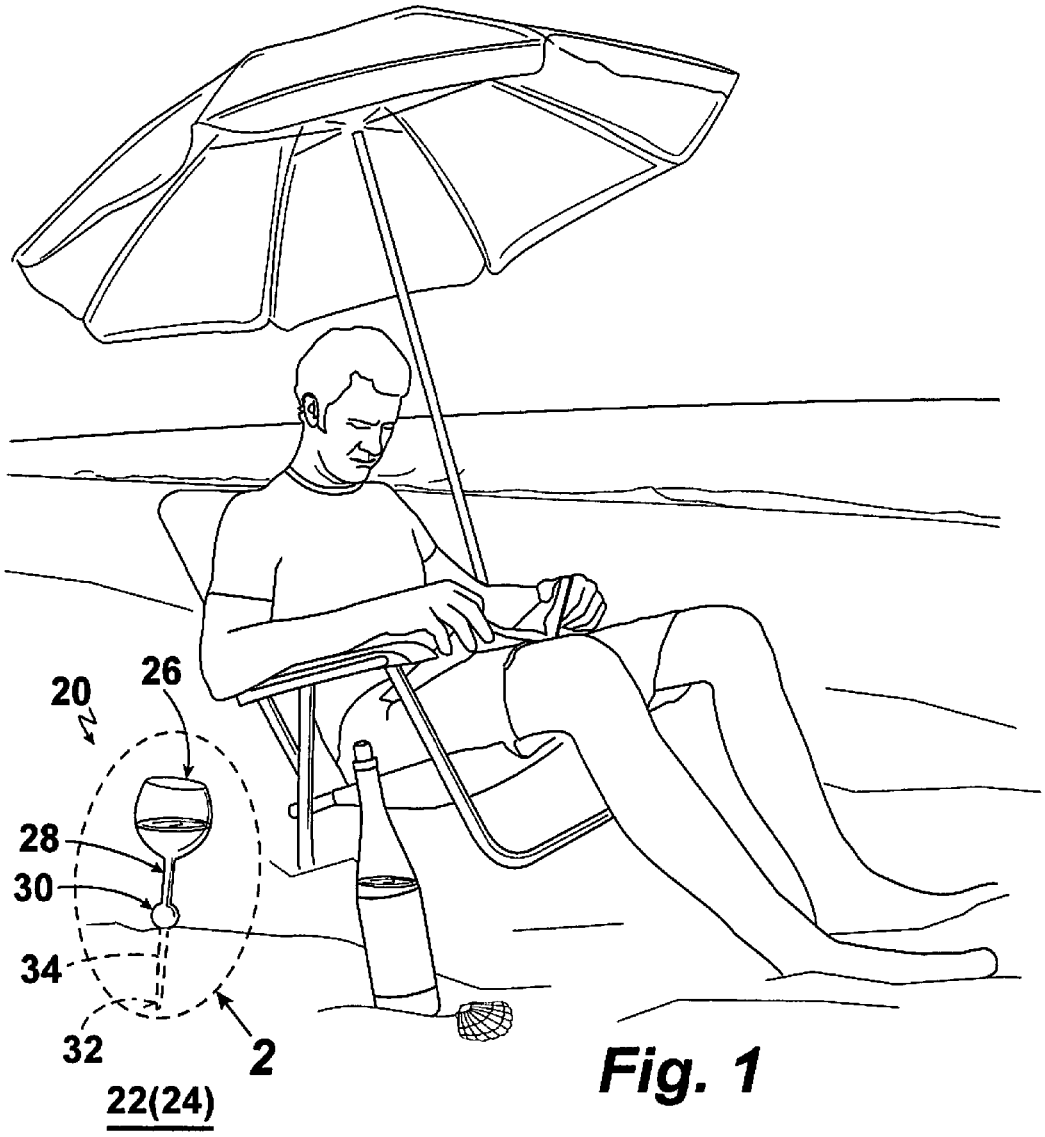
FIG. 1 is a perspective view showing a drinking glass portion of the present invention in use.

20 glass of embodiments of present invention for being self-supporting in substance 22 consisting of sand, earth, snow, water or vegetation 24
22 substance consisting of sand, earth, snow, water or vegetation 24
24 sand, earth, snow, water or vegetation
26 bowl
28 stem
30 apparatus for maintaining glass 20 upright in substance 22 consisting of sand, earth, snow, water or vegetation 24
32 point of stem 28 for inserting into substance 22 consisting of sand, earth, snow, water or vegetation 24
34 spike of stem 28
122 substance consisting of sand, earth, snow, water or vegetation 24
124 sand, earth, snow, water or vegetation
126 bowl
128 stem
130 apparatus for maintaining glass 120 upright in substance 122 consisting of sand, earth, snow, water or vegetation 124
132 point of stem 128
134 spike of stem 128
136 sphere of apparatus 130 for maintaining glass 120 upright in substance 122 consisting of sand, earth, snow, water or vegetation 124
228 stem
230 apparatus
236 sphere of apparatus 230
238 through bore of sphere 236 of apparatus 230
240 through bore of stem 228 of apparatus 230
242 tapered pin of apparatus 230
328 stem
330 apparatus
336 sphere of apparatus 330
338 through bore of sphere 336 of apparatus 330
344 bayonet mount of apparatus 330
346 pair of radial pins of stem 328 of bayonet mount 44 of apparatus 230
348 pair of L-shaped slots of sphere 336 of bayonet mount 44 of apparatus 330
450 caddy
452 disc of caddy 450
454 periphery of disc 452 of caddy 450
456 center of disc 452 of caddy 450
458 plurality of through bores of disc 452 of caddy 450
460 plurality of mouths of disc 452 of caddy 450
462 shaft of caddy 450
464 terminal end of shaft 462 of caddy 450
466 ball of caddy 450

DETAILED DESCRIPTION OF THE PREFERRED EMBODIMENT

Referring now to the figures, in which like numerals indicate like parts, and particularly to FIG. 1, the glass of the embodiments of the present invention is shown generally at 20 for being self-supporting in a substance 22 consisting of sand, earth, snow, water or vegetation 24.

The overall configuration of the glass 20 can best be seen in FIG. 1, and as such, will be discussed with reference thereto.

The glass 20 comprises a bowl 26, a stem 28, and apparatus 30 for maintaining the glass 20 upright in the substance 22 consisting of sand, earth, snow, water or vegetation 24.

The stem 28 depends from the bowl 26 to a point 32 so as to form a spike 34. The spike 34 of the stem 28 is for inserting into the substance 22 consisting of sand, earth, snow, water or vegetation 24.

The apparatus 30 is disposed on the stem 28, approximately midway between the bowl 26 and the point 32 of the stem 28.

The spike 34 of the stem 28 extends from the apparatus 30 to the point 32 of the stem 28.

Figure 2:
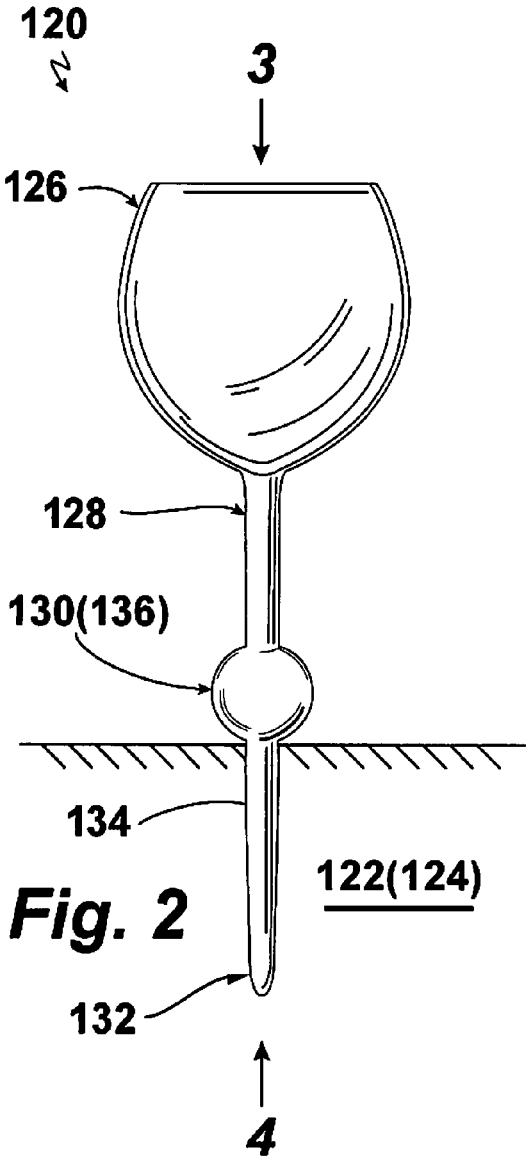
FIG. 2 is a side elevational view of a first embodiment of a drinking glass portion of the invention per se, as seen in the area enclosed in the dotted curve indicated by arrow 2 in FIG. 1.
Figure 3:
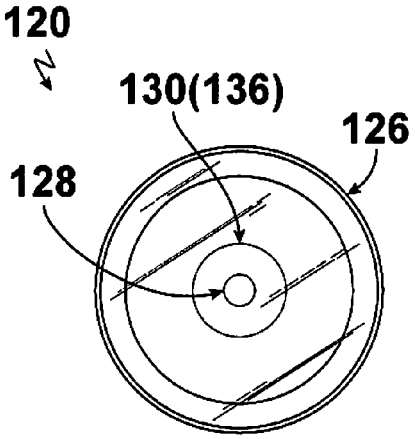
FIG. 3 is a top plan view thereof, taken in the direction of arrow 3 in FIG. 2.
Figure 4:
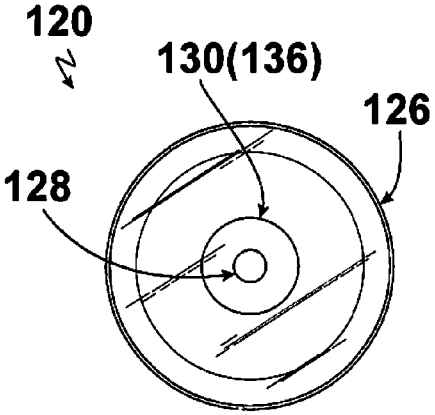
FIG. 4 is a bottom plan view thereof, taken in the direction of arrow 4 in FIG. 2.

The specific configuration of a first embodiment of the apparatus 130 can best be seen in FIGS. 2, 3, and 4, and as such, will be discussed with reference thereto.

The apparatus 130 includes a sphere 136.

The sphere 136 of the apparatus 130 is formed as one-piece with the stem 128, is coaxial with the stem 128, is smaller than the bowl 126, is disposed approximately midway between the bowl 126 and the point 132 of the stem 128, and when the spike 134 of the stem 128 is inserted into the substance 122 consisting of sand, earth, snow, water or vegetation 124 up to the sphere 136 of the apparatus 130, the glass 120 is maintained upright in the substance 122 consisting of sand, earth, snow, water or vegetation 124.

Figure 5:
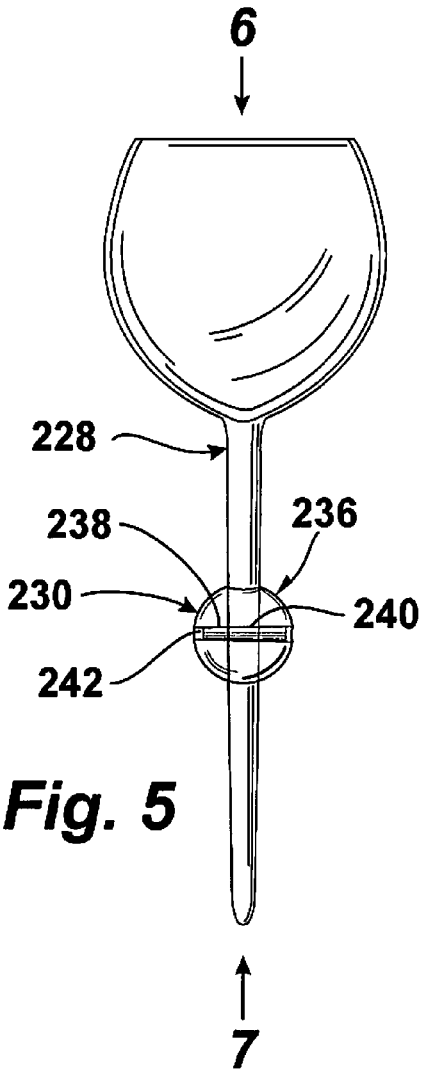
FIG. 5 is a side elevational view of a second embodiment of a drinking glass portion of the invention per se, as seen in the area enclosed in the dotted curve indicated by arrow 2 in FIG. 1.
Figure 6:
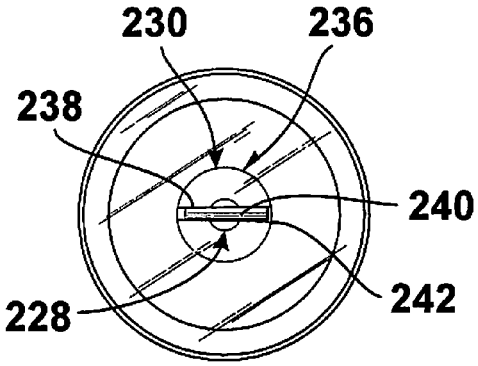
FIG. 6 is a top plan view thereof, taken in the direction of arrow 6 in FIG. 5.
Figure 7:
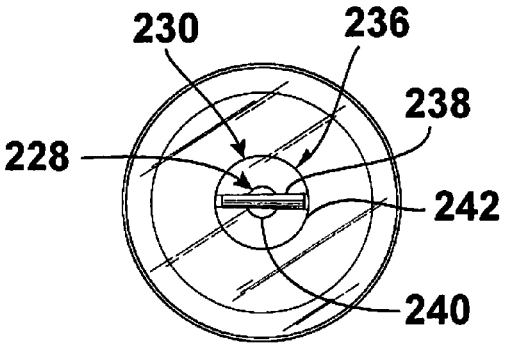
FIG. 7 is a bottom plan view thereof, taken in the direction of arrow 7 in FIG. 5.
Figure 8:
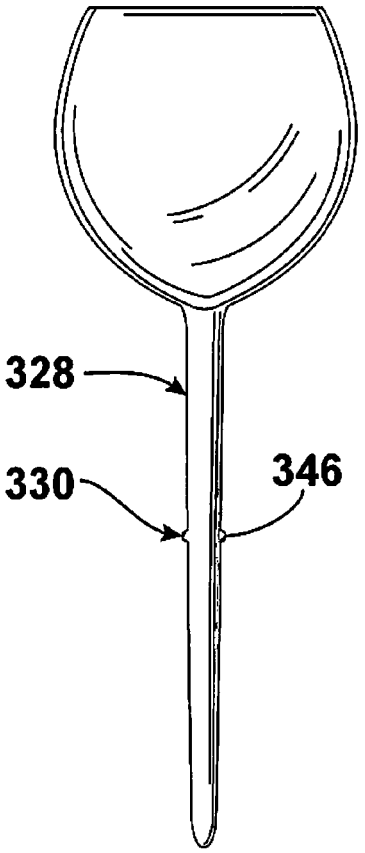
FIG. 8 is a side elevational view of a third embodiment of a drinking glass portion of the invention per se, which has bayonet projections, on a stem portion, for cooperating with corresponding L-shaped grooves in a conical opening in a removable spherical component.
Figure 9:
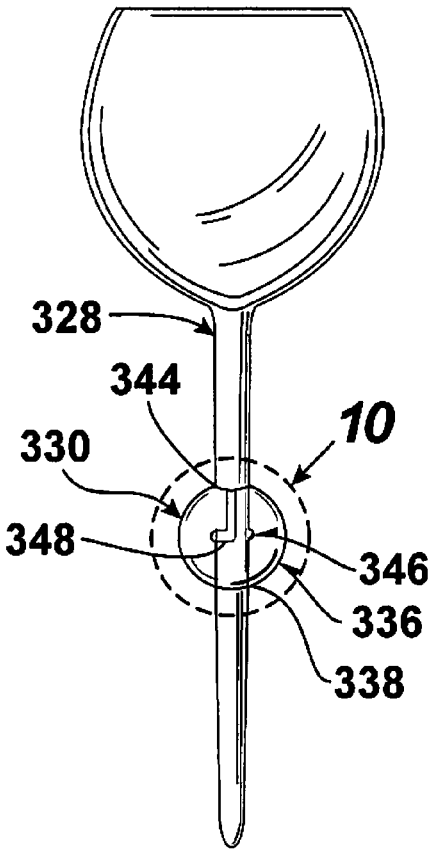
FIG. 9 is a side elevational view of a third embodiment of the drinking glass portion of the invention per se, as seen in the area enclosed in the dotted curve indicated by arrow 2 in FIG. 1, after the spherical component has been installed on the stem portion and secured thereto utilizing the bayonet mechanism.
Figure 10:
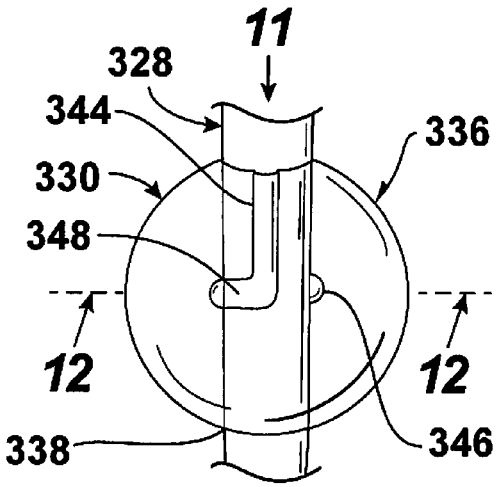
FIG. 10 is an enlarged diagrammatic perspective view of the removable spherical component seen in the area enclosed in the dotted circle indicated by arrow 10 in FIG. 9.
Figure 11:
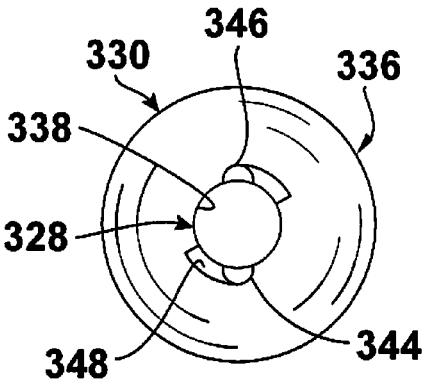
FIG. 11 is a top plan view taken in the direction of arrow 11 in FIG. 10 of the spherical component per se.
Figure 12:
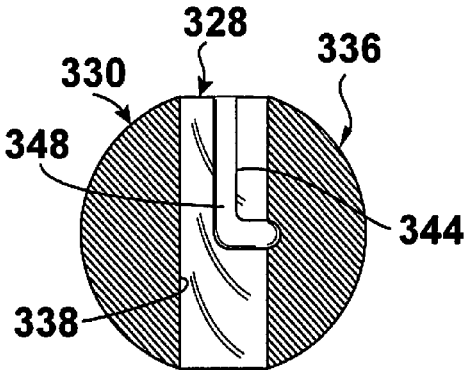
FIG. 12 is a cross sectional view taken on line 12-12 in FIG. 10 of the spherical component per se.
Figure 13:
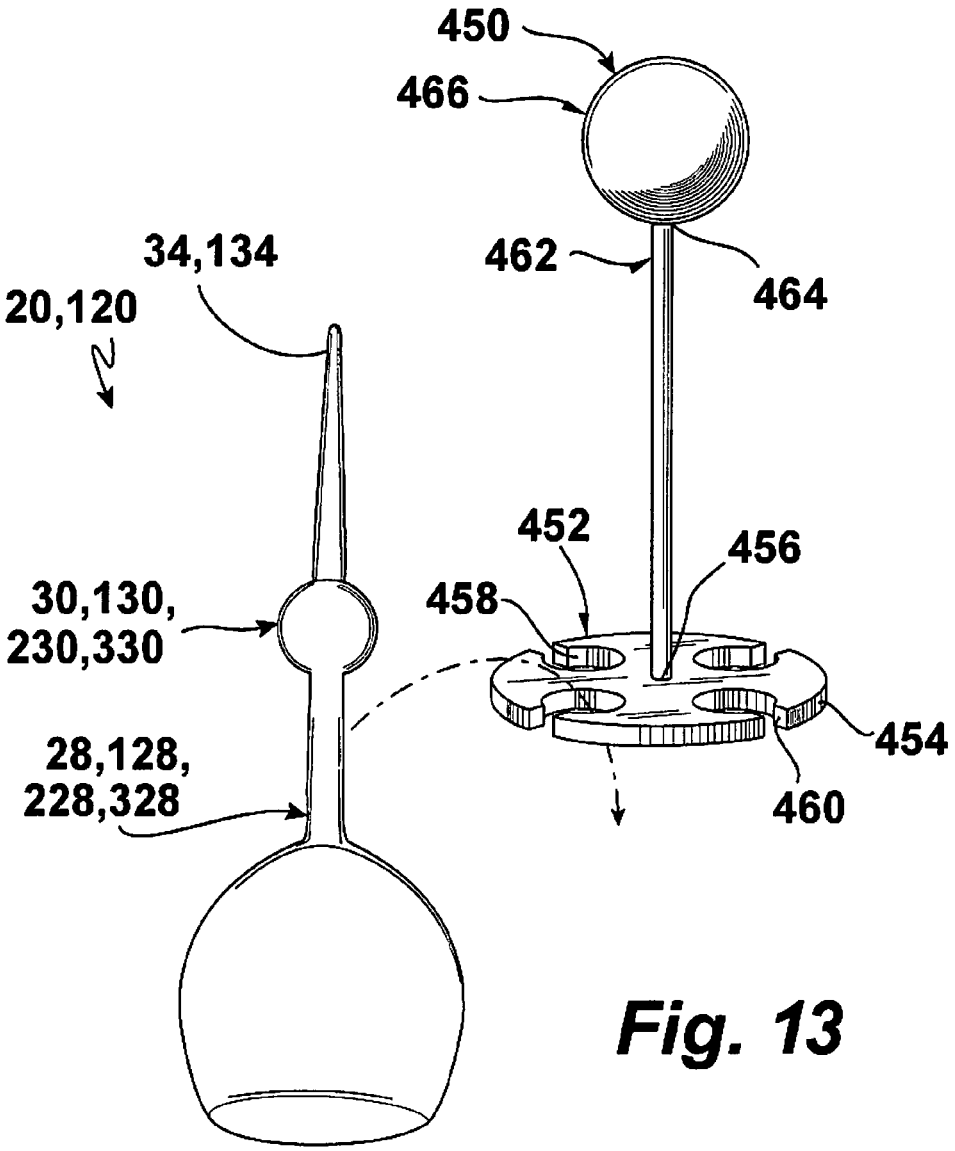
FIG. 13 is a diagrammatic perspective view of the present invention illustrating a cooperating caddy with a drinking glass about to be placed therein.
Figure 14:
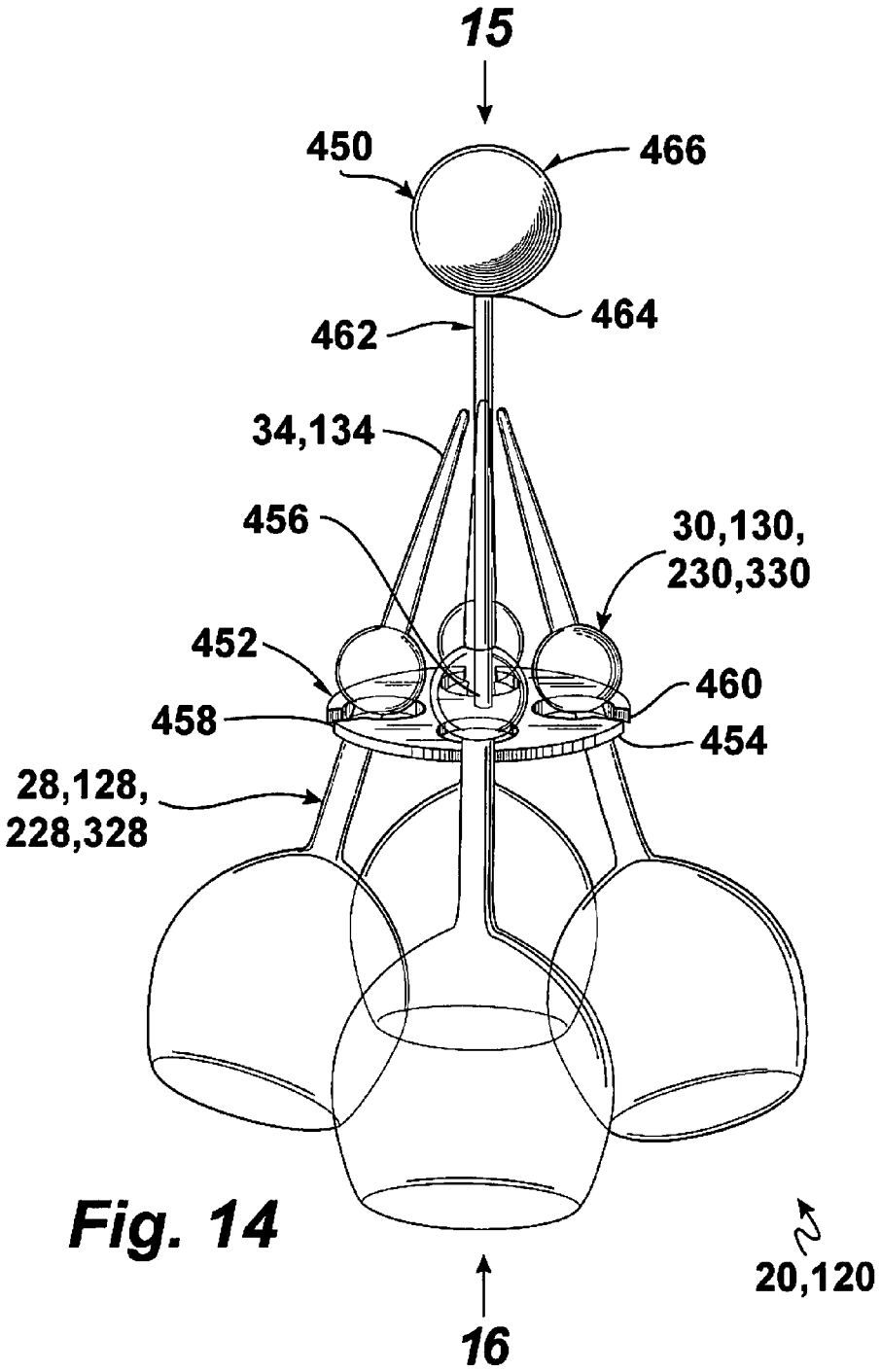
FIG. 14 is a diagrammatic perspective view illustrating a set of four glasses loaded in the cooperating caddy portion of the invention.
Figure 15:
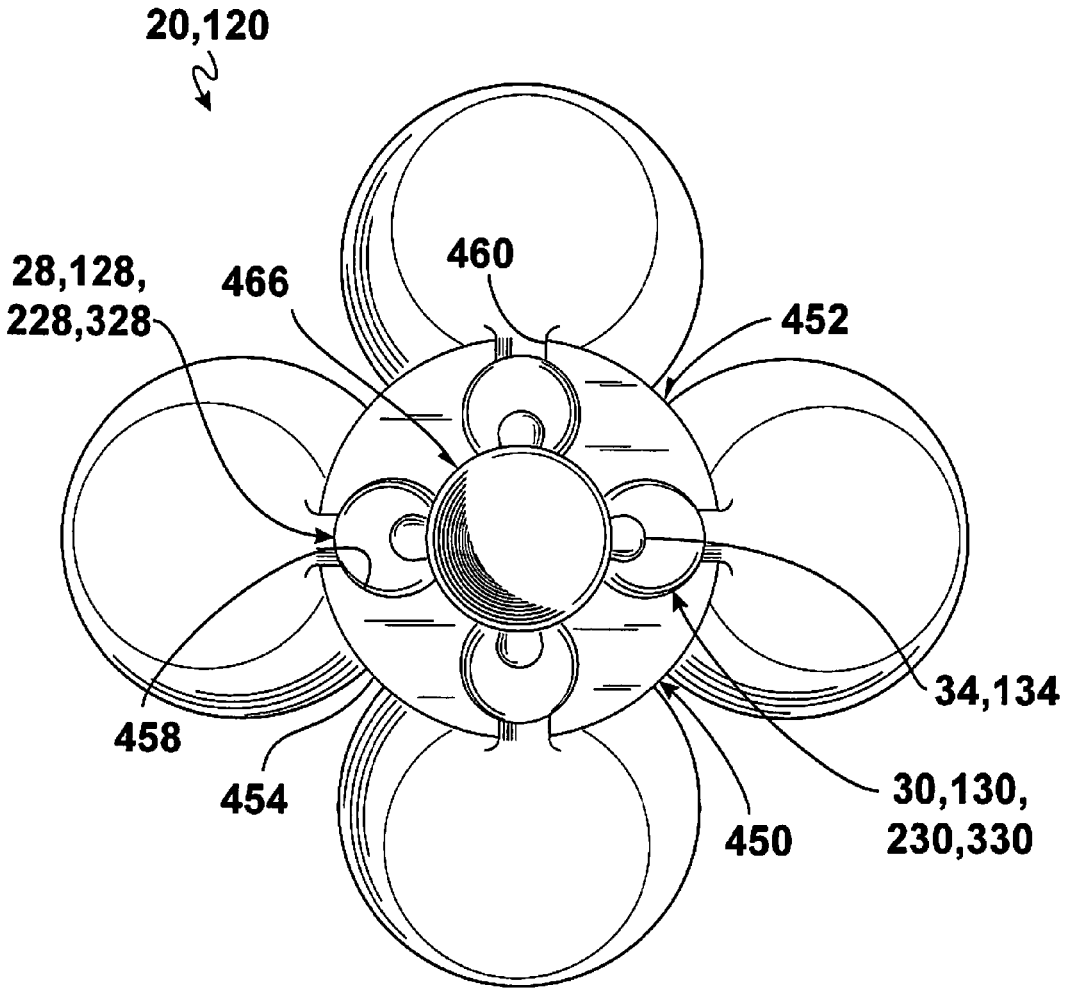
FIG. 15 is a top plan view thereof, taken in to direction of arrow 15 in FIG. 14.
Figure 16:
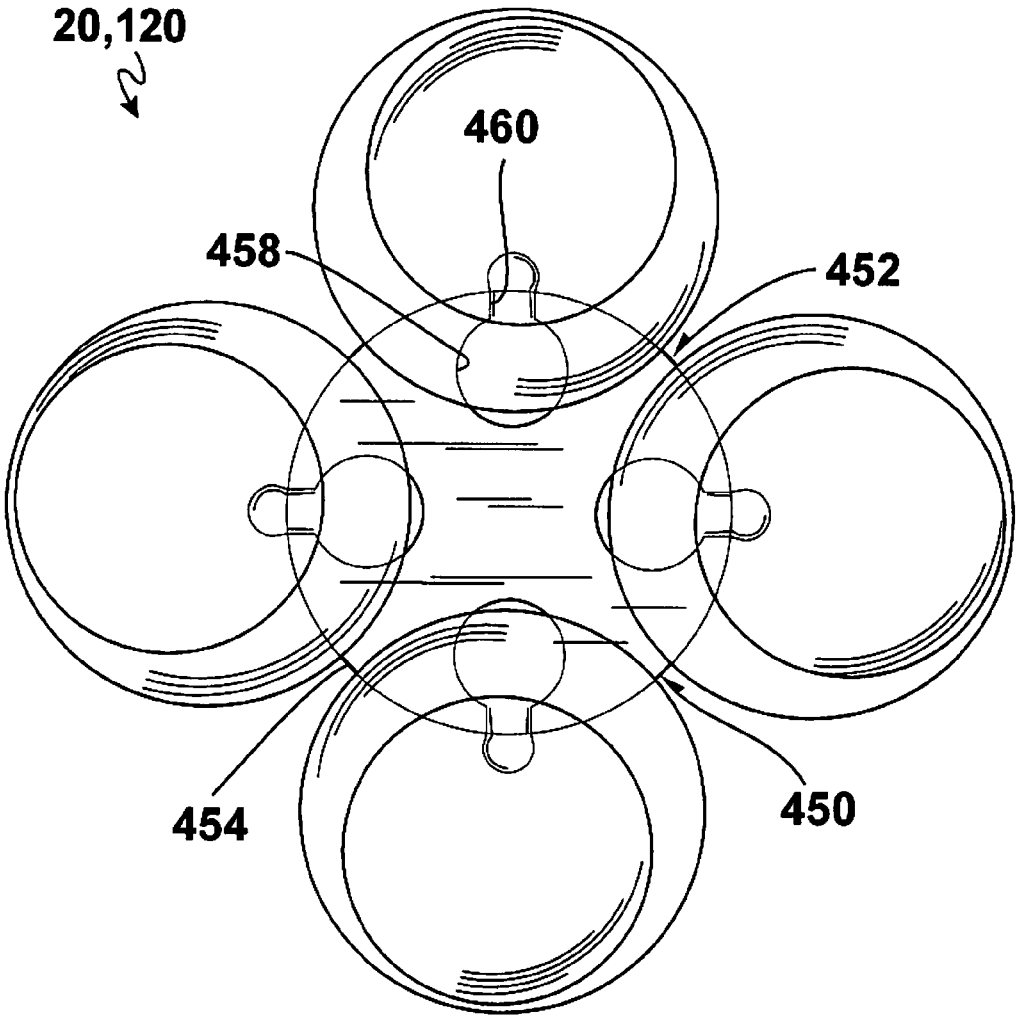
FIG. 16 is a bottom plan view thereof, taken in to direction of arrow 16 in FIG. 14.

The specific configuration of a second embodiment of the apparatus 230 can best be seen in FIGS. 5, 6, and 7, and as such, will be discussed with reference thereto.

The apparatus 230 is similar to the apparatus 130, except that:

The sphere 236 of the apparatus 230 is replaceably attached to the stem 228;

The apparatus 230 has the sphere 236 of the apparatus 230 having a through bore 238 that is tapered and extends laterally therethrough;

The apparatus 230 has the stem 228 having a through bore 240 that is tapered, extends laterally therethrough, and is aligned with the through bore 238 of the sphere 236 of the apparatus 230;

The apparatus 230 has a tapered pin 242; and

The tapered pin 242 of the apparatus 230 extends replaceably through the through bore 240 of the stem 228 of the apparatus 230 and through the through bore 238 of the sphere 236 of the apparatus 230.

The specific configuration of a third embodiment of the apparatus 330 can best be seen in FIGS. 8, 9, 10, 11, and 12, and as such, will be discussed with reference thereto.

The apparatus 330 is similar to the apparatus 230, except that:

The sphere 336 of the apparatus 330 is replaceably attached to the stem 328 by a bayonet mount 344;

The apparatus 330 has the sphere 336 of the apparatus 330 having a through bore 338 that extends axially therethrough;

The apparatus 330 has the stem 328 having a pair of radial pins 346; and The apparatus 330 has the sphere 336 of the apparatus 330 having a pair of L-shaped slots 348 that communicate with the through bore 338 of the sphere 336 of the apparatus 330, and cooperate with the pair of radial pins 346 of the stem 328 of the apparatus 330, respectively.

As shown in FIGS. 13, 14, 15, and 16, the glass 20, 120 further comprises a caddy 450.

The caddy 450 transports and stores at least one glass 20, 120, up-side-down, via the apparatus 130, 230, and 330.

The caddy 450 comprises a disc 452.

The disc 452 of the caddy 450 is horizontally disposed, and has a periphery 454 and a center 456.

The disc 452 of the caddy 450 has a plurality of through bores 458 that are vertically disposed, and communicate with the periphery 454 of the disc 452 of the caddy 450 to form a plurality of mouths 460, respectively, so as to allow the stem 28, 128, 228, and 328 of the glass 20, 120 that is up-side-down to pass through a mouth 460 of the disc 452 of the caddy 450 into an associated through bore 458 of the disc 452 of the caddy 450 and be maintained thereat by the apparatus 30, 130, 230, and 330 resting on the disc 452 of the caddy 450.

The caddy 450 further comprises a shaft 462.

The shaft 462 of the caddy 450 extends vertically upwardly from the center 456 of the disc 452 of the caddy 450 to a terminal end 464.

The caddy 450 further comprises a ball 466.

The ball 466 of the caddy 450 is disposed on the terminal end 464 of the shaft 462 of the caddy 450 and provides a handle to transport the caddy 450.

The shaft 462 of the caddy 450 spaces the ball 466 of the caddy 450 far enough away from the disc 452 of the caddy 450 to provide adequate clearance for the spike 34 of the glass 20, 120 that the caddy 450 is storing or transporting up-side-down.

It will be understood that each of the elements described above, or two or more together, may also find a useful application in other types of constructions differing from the types described above.

While the invention has been illustrated and described as embodiments of a beach glass and cooperating caddy for storing or transporting, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A glass for being self-supporting in a substance selected from the group consisting of sand, earth, snow and vegetation, comprising:

a) a bowl;

b) a stem; and c) means for maintaining said glass upright in the substance selected from the group consisting of sand, earth, snow and vegetation;

wherein said stem depends from said bowl to a point so as to form a spike; and wherein said spike of said stem is for inserting into the substance selected from the group consisting of sand, earth, snow and vegetation;

wherein said means includes a sphere;

wherein said sphere of said means is coaxial with said stem;

wherein said sphere of said means is smaller than said bowl;

wherein said sphere of said means is disposed approximately midway between said bowl and said point of said stem.

2. The glass of claim 1, wherein said means is disposed on said stem.

3. The glass of claim 1, wherein said means is approximately midway between said bowl and said point of said stem.

4. The glass of claim 1, wherein said spike of said stem extends from said means to said point of said stem.

5. The glass of claim 1, wherein said glass is maintained upright in the substance selected from the group consisting of sand, earth, snow and vegetation when said spike of said stem is inserted into the substance selected from the group consisting of sand, earth, snow and vegetation up to said sphere of said means.

6. The glass of claim 5, wherein said sphere of said means is formed as one-piece with said stem.

7. The glass of claim 5, wherein said sphere of said means is replaceably attached to said stem.

8. The glass of claim 7, wherein said means has said sphere of said means having a through bore.

9. The glass of claim 8, wherein said through bore of said sphere of said means is tapered.

10. The glass of claim 9, wherein said through bore of said sphere of said means extends laterally therethrough.

11. The glass of claim 10, wherein said means has said stem having a through bore.

12. The glass of claim 11, wherein said through bore of said sphere of said means is tapered.

13. The glass of claim 12, wherein said through bore of said stem of said means extends laterally therethrough.

14. The glass of claim 13, wherein said through bore of said sphere of said means is aligned with said through bore of said stem of said means.

15. The glass of claim 14, wherein said means includes a tapered pin.

16. The glass of claim 15, wherein said tapered pin of said means extends replaceably through said through bore of said stem of said means and through said through bore of said sphere of said means.

17. The glass of claim 7, wherein said sphere of said means is replaceably attached to said stem by a bayonet mount.

18. The glass of claim 17, wherein said means has said sphere of said means having a through bore.

19. The glass of claim 18, wherein said through bore of said sphere of said means extends axially therethrough.

20. The glass of claim 19, wherein said means has said stem having a pair of radial pins.

21. The glass of claim 20, wherein said means has said sphere of said means having a pair of L-shaped slots.

22. The glass of claim 21, wherein said pair of L-shaped slots of said sphere of said means communicate with said through bore of said sphere of said means.

23. The glass of claim 22, wherein said pair of L-shaped slots of said sphere of said means cooperate with said pair of radial pins of said stem of said means.

* * * * *